United States Patent [19]

Woodworth

[11] 4,426,806

[45] Jan. 24, 1984

[54] MODEL LANDSAILER

[76] Inventor: Lee M. Woodworth, R.F.D. 4, Long Pond Rd., Plymouth, Mass. 02360

[21] Appl. No.: 315,141

[22] Filed: Oct. 26, 1981

[51] Int. Cl.[3] ..... A63H 30/04; G09B 9/06

[52] U.S. Cl. ..... 46/248; 46/210; 280/213; 434/60

[58] Field of Search ..... 46/201, 202, 206, 208, 46/209, 251, 252, 253, 254, 255, 262, 93, 96, 248; 114/39, 43, 123; 434/60; 280/1, 213

[56] References Cited

U.S. PATENT DOCUMENTS

| | | | |
|---|---|---|---|
| 604,180 | 5/1898 | Todd | 46/206 |
| 1,132,924 | 3/1915 | Gepack | 114/123 |
| 1,270,466 | 6/1918 | Van Buren | 46/93 |
| 1,440,794 | 1/1923 | Rayder | 46/96 |
| 2,238,464 | 4/1941 | Fletcher | 114/39 |
| 2,351,542 | 6/1944 | Paull | 46/93 |
| 3,280,501 | 10/1966 | Hornbostel | 46/254 X |
| 4,190,980 | 3/1980 | Grycel | 46/93 |
| 4,224,762 | 9/1980 | McCaslin | 46/254 X |
| 4,270,307 | 6/1981 | Arigaya | 46/254 X |

FOREIGN PATENT DOCUMENTS

| | | | |
|---|---|---|---|
| 375268 | 9/1921 | Fed. Rep. of Germany | 280/213 |
| 2006597 | 9/1971 | Fed. Rep. of Germany | 46/253 |
| 468779 | 5/1914 | France | 280/1 |
| 1467880 | 12/1966 | France | 114/123 |
| 623458 | 7/1961 | United Kingdom | 434/60 |

*Primary Examiner*—F. Barry Shay

*Attorney, Agent, or Firm*—Weingarten, Schurgin, Gagnebin & Hayes

[57] ABSTRACT

A remote controlled model landsailer includes a wheeled vehicle having a sail supported on a mast with a fixed rig position, in which realistic heeling is produced by an outrigger structure including a transversely-mounted resilient wire having wheels at either end thereof, with the elasticity of the wire providing for realistic heeling of the vehicle while at the same time preventing the vehicle capsizing. The model landsailer is remote controlled, in one embodiment, with a single remote control radio channel which is utilized to control the position of the nose wheel of a three-wheel support structure, with the single channel radio controlled operation permitting all sailing maneuvers including heading up, jibes, tacking, coming about and runs, and with the flexible wire outrigger providing realistic visual feedback to the operator of the radio control unit. Features of the vehicle include single pivot steering, a mast which serves as an antenna, a fixed position lateen rig, a one piece slip pocket sail, and a boom and yard coupling which permits rotation about the longitudinal axis of these elements to permit sail shaping.

10 Claims, 11 Drawing Figures

POSITION A

POSITION B

POSITION C

WIND
POSITION A
POSITION B
POSITION C

MODEL LANDSAILER

FIELD OF THE INVENTION

This invention relates to model vehicles and more particularly to a remotely controlled wind driven wheeled vehicle.

BACKGROUND OF THE INVENTION

Land vehicles propelled by sail includes such toy boats as that illustrated in U.S. Pat. No. 2,351,542, in which a reversed tricycle wheel structure is utilized to support a sail or sails which approximate sloop rigging. Here the rigging is fixed by virtue of the jib sheet and the main sheet being cleated down. This vehicle is unattended and no radio control is provided for the toy boat of the abovementioned patent. Moreover, there is no provision for automatic steering of the toy boat. The problem with this and any other unmanned or unattended landsailers is that the vehicle readily tips over in even moderate winds, since there is no provision for prevention of capsizing or tipping over, either in terms of the steering of the vessel or in terms of providing other mechanisms to prevent the tipping over of the vehicle.

As illustrated in U.S. Pat. No. 4,049,287, attended or manned wind driven vehicles or landsailers have been provided with accommodations for an individual so that the individual may trim the main sheet in order to prevent capsizing of the landsailer. However in model vehicles which are unattended, the tipping over of the vehicle is the most serious problem.

Thus, in terms of providing a successful unattended model landsailer, it will be appreciated that the most important problem is to provide some way of preventing the model landsailer from tipping over. Even if this were provided by a radio controlled steering system or by a radio controlled sheeting system, the traditional tricycle gear are provided for a model vehicle, this does not result in the same type of heeling as experienced in a water-borne vessel with a keel, in which the keel resists the action of the wind against the sail. Thus not only are model unattended landsailers difficult to keep upright, but also the way in which the model landsailer reacts to the wind varies markedly from the way the water-borne sailing vessels react to the wind.

More specifically, water-borne sailing vessels start to heel quickly upon the reaction with a gust of wind, but then react more rigidly as the vessel heels until such time as the vessel achieves a more or less maximum angle of heel which the vessel maintains as long as the wind velocity does not change. Previous unattended wind driven models react quite differently in that up until the time that the model heels at all, the model is level with the ground. Should the wind velocity overcome the center of gravity of the model, it heels over very quickly such that it tips over without any notable resistance to the wind. Even if it were possible to remotely control the direction of such a model landsailer, the reaction time to keep the vehicle upright would be too short.

In summary, prior art model landsailers do not give the visual impression or feedback of a water-borne sailing vessel which makes the actions of the model sailing vessel difficult, if not impossible, to control via remote control means. Either the prior art vessel tips over before corrective action can be taken or the model vessel does not give any indication of the power of the wind acting on it until it is too late to do anything about it. This makes such model landsailers very frustrating devices to sail and poor devices for the instruction of sailing, since their actions do not in any way approximate those of a water-borne sailboat.

Water-borne model sailboats have been provided with multiple radio control channels, such as illustrated in U.S. Pat. No. 3,280,501, in which a model sailboat is provided with radio controlled sheeting of a main sail as well as radio controlled rudders. It will be appreciated that the direction of the water-borne model may be controlled by control of the rudder to kill the heel of the vessel, or the main sheet may be released via radio control to kill the heel of the vessel. Model sailboat radio controlled sheeting winches are shown in U.S. Pat. No. 4,190,980, again for water-borne type vehicles.

It will of course be appreciated that water-borne vehicles have been provided with outriggers for prevention of capsizing and in general, these outriggers have been either of a rigid variety or the point of attachment of the rigid outrigger to the hull or body of the ship is hinged with resilient means such as shock absorbers to limit the movement of the hinged outrigger. Such hinged outriggers are illustrated, for instance, in U.S. Pat. No. 3,881,440; 1,128,062; and 3,954,077. Rigid outriggers, especially for iceboats, including wheeled iceboats, include U.S. Pat. Nos. 2,238,464 and 1,082,831. Moreover, the positioning of pontoons or outriggers with respect to a central hull, is described in terms of extensible spring-loaded supports by U.S. Pat. No. 4,192,247. In none of these patents is the horizontal outrigger flexible along its length.

SUMMARY OF THE INVENTION

In one aspect, the subject invention includes a model landsailer which is remotely controlled. The ability to provide a successful remotely controlled model landsailer in one embodiment includes providing the vehicle with a wheeled outrigger transverse to the longitudinal axis of the vehicle, in which the outrigger is flexible along its length. In one embodiment, the flexible outrigger is provided by a piano wire, mounted transverse to the longitudinal axis of the vehicle, with wheels at either end of the piano wire. The piano wire is sufficiently flexible such that when the vehicle is driven into a heeling position, the heeling is opposed by the resiliency of the piano wire so as to approximate the reaction of a water-borne sailing vessel to a puff of wind. The piano wire provides a righting moment similar to that provided by a keel or crew members on the leeward rail of a vessel and thus provides a visual cue or feedback to the person controlling the direction of the model landsailer. The flexible outrigger structure, being provided with wheels and/or skids, does not produce sufficient drag to cause the vehicle to swerve in the direction of the outrigger wheel which is contacting the ground.

The wheeled outrigger structure thus provides two functions. First, it prevents the model landsailer from immediately tipping over with a gust of wind. Secondly, because of its resilient nature, it provides the vehicle with a reaction to the wind which approximates that of a water-borne sailing vessel. These two factors permit single channel radio control of the model landsailer which, in one embodiment, has a lateen rig sheeted in at a predetermined angle. With the sail sheeted in at this angle, the vehicle can be made to execute all sailing maneuvers including tacking, running and jibbing through the exercise of a single radio control channel. In a preferred embodiment, this single channel is utilized to control the direction of a nose wheel. Since the model can be controlled in all of its aspects by a single radio channel, it is easily operated by a novice having little or no knowledge of sailing. This makes the model extremely attractive in the teaching of such maneuvers as running, tacking and jibbing to those uninitiated in sailing. This is because a single control channel is more easily manipulated than are multiple controls which might include, for instance, a radio controlled sheeting winch. One channel also keeps the weight down so as to improve performance to the extent that the landsailer will go in as little as three knots of wind.

More particularly, a model, such as described, is very useful in teaching individuals how to kill a heel by coming into the wind, as well as teaching an individual the response of a vessel to the wind in terms of how far the vessel will heel under various wind conditions.

Note that the subject invention includes the use of a flexible outrigger, whether the vehicle is remotely controlled or not, and whether or not the vehicle is land-based.

In one embodiment the outrigger is mounted such that upon running with the wind, the wheels or skids at the ends of the outrigger do not touch the ground. The only time that an outrigger wheel or skid touches the ground is when the vehicle is either tacking or on a reach, with the degree of heeling being dependent upon wind velocity and the angle of the vehicle with the which the bell crank is driven by a conventional radio control servo and receiver.

As another feature of the subject invention, the mast may provide not only for the securing of the sail to the vehicle, but also as an antenna for a radio control unit. In one embodiment the mast is demountable through an aperture in the top of the vehicle and is secured at its butt or base to a mast step which includes a conventional banana plug that couples the antenna contained within the mast to the radio receiver within the vehicle.

In another embodiment, balasting for the model landsailer is accomplished by positioning the battery for the receiver immediately forward of the rear fixed wheels, with the battery providing a relatively low center of gravity.

Additionally, the outrigger wheels may be of a smaller diameter than the rear fixed wheels, with the outrigger being directly above the axle for the fixed wheels. In this manner, the outrigger wheels are carried above the fixed wheels so that they contact the earth or ground only when the vehicle has heeled over by a predetermined amount, normally 10° from vertical. This provides that the action of the model landsailer approximate that of a water-borne sailing vessel, in that the model heels very quickly responsive to a puff of wind, which wind force is then resisted by the resiliency of the flexible outrigger, such that for a given wind velocity, the heeling angle for the model landsailer will stabilize, as would be the case in a water-borne sailing vessel.

A slip-pocket sail is provided which slips over a rigid boom and a yard. The two sail supporting members are the position of the battery within the landsailer, the connection of the mast/antenna structure to an internally carried receiver provided with a bell crank actuator, and the cleating of the sheet for the sail so that the sail is free to swing within a limited arc about the centerline of the landsailer;

Figure 9:
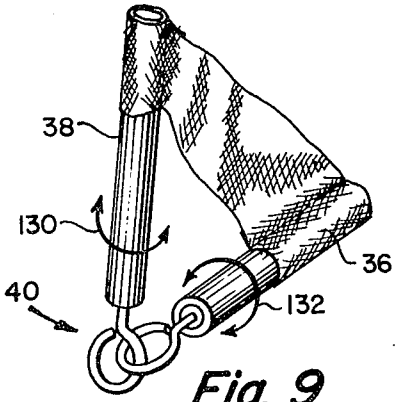
Figure 8:
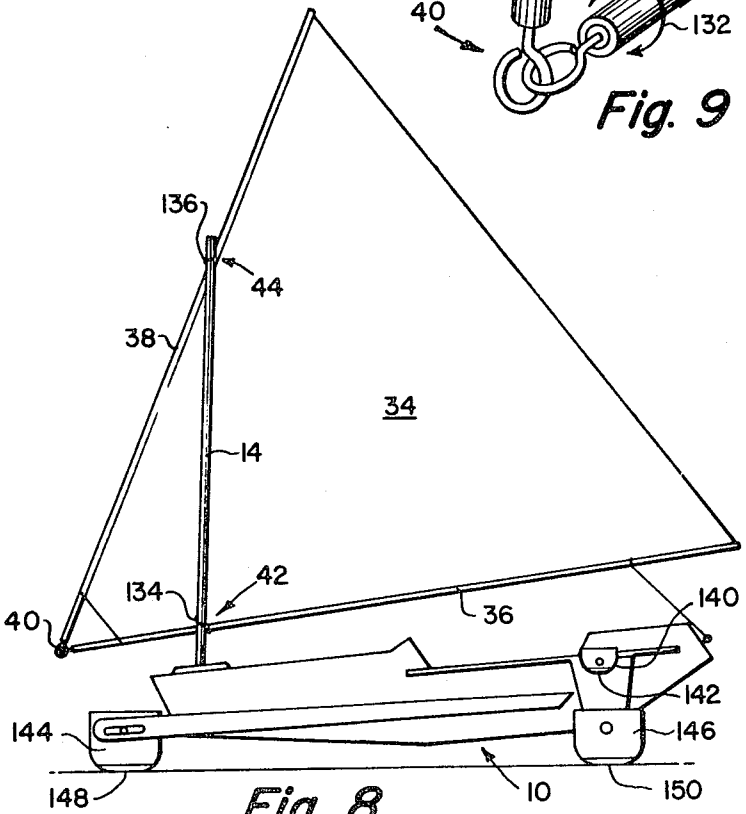

FIG. 8 is a diagrammatic representation of the lateen sail utilized with a landsailer provided with skids, indicating the rigid boom and yard joined at their forward ends, with the boom and yard being mounted to a raked upstanding mast by resilient means including threads or strings; and, FIG. 9 is a diagrammatic representation of the forward ends of the yard and boom, illustrating the rotatable coupling for the ends of these members.

DETAILED DESCRIPTION OF THE INVENTION

Figures 1A, 1B, 1C, 2:
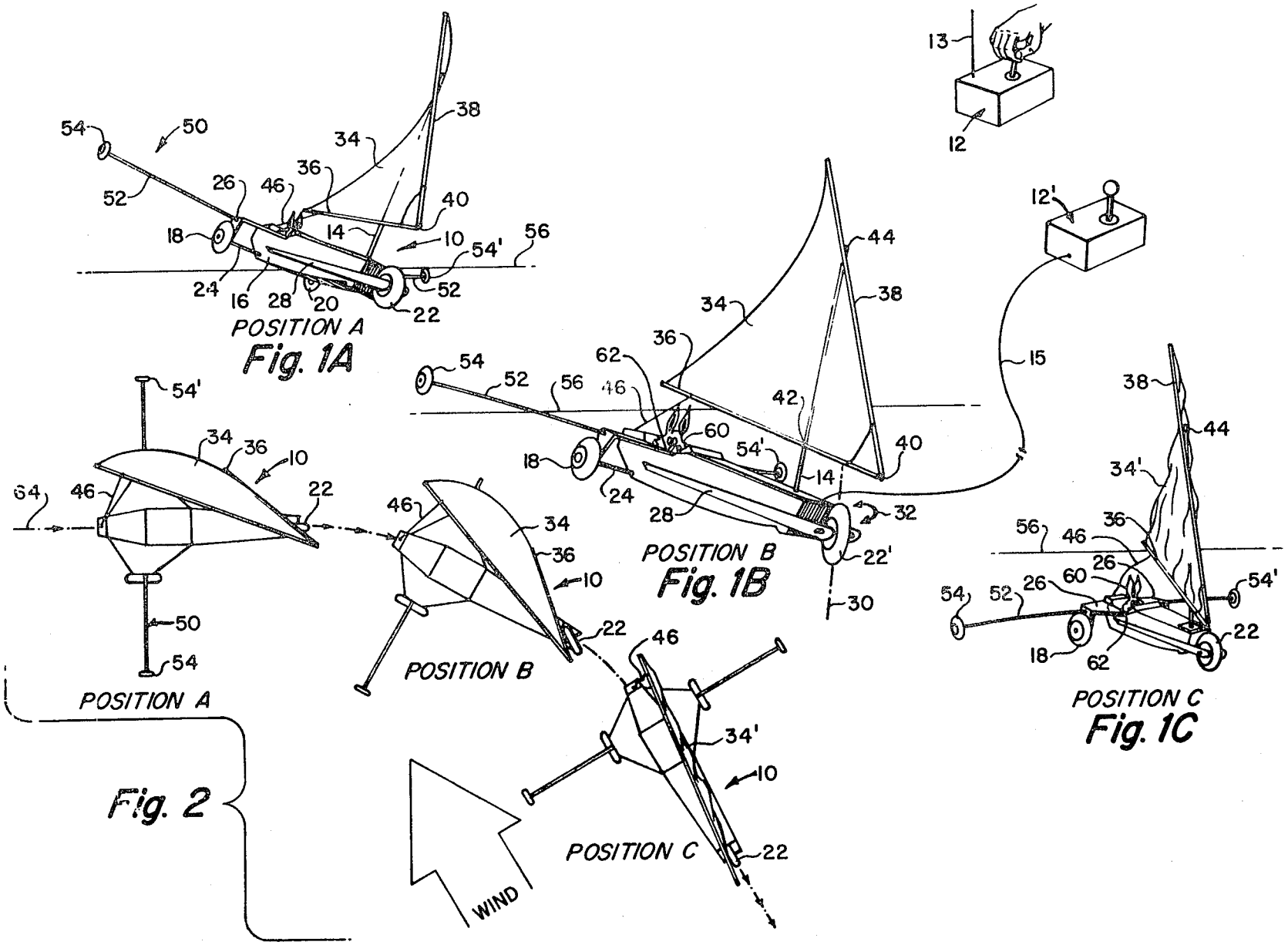

Referring to FIGS. 1A, 1B and 1C, a wind driven vehicle or landsailer, generally indicated at 10, is illustrated in three positions, positions A, B and C, as the landsailer moves from a tacking position to a position, during tacking, in which the landsailer is directly into the wind. The landsailer is controlled in direction by a single channel radio control unit 12, which transmits signals via antenna 13 to a mast/antenna 14 of the landsailer. Remote control also includes the use of a hard wire link 15 from control unit 12' to vehicle 10. This link may either be electrical or mechanical to control the direction of the landsailer. In general, the landsailer includes a vehicle body 16 and a tricycle or three wheel support system including wheels 18, 20 and 22. Wheels 18 and 20 are carried on an axle 24 which extends transversely through the lower part of vehicle body 16 and is supported by bent struts 26 which run outwardly from the vehicle body and then down. Wheel 22 is mounted to a yoke 28 and is pivotable about a vertical axis 30 so as to be rotatable in the direction of arrow 32 about this axis. As will be discussed, the pivotal mounting of wheel 22 may include a single axis pivot described in connection with FIGS. 5 and 6.

The sail carried by this vehicle, in a preferred embodiment, is lateen sail 34, which is suspended between a boom 36 and a yard 38, with the forward ends of the boom and the yard being joined at a forward point 40. Boom 36 is secured to mast 14 in a flexible joint at point 42, whereas yard 38 is flexibly joined to mast 14 at point 44.

The aft end of the boom is tethered to the aft end of the vehicle via a sheet 46 which is cleated or otherwise secured so that sail 34 may swing in a predetermined arc about the centerline of the landsailer.

The righting moment for the model landsailer is provided by an outrigger, generally indicated at 50, to include a flexible member 52 which may be a piano wire. Note, it is a feature of the wire that it is flexible along its length. Wheels 54 are located at the ends of member 52, with wheel 54' illustrated as contacting the ground in FIGS. 1A and 1B. The horizon is illustrated in all cases by line 56.

The righting moment established by flexible outrigger 50 is determined by the flexibility of member 52 itself and, in one embodiment, a 3/32" piano wire is utilized as this outrigger, which extends 15 inches from each side of the vehicle. A figure 60 is illustrated as being in the cockpit 62 of the landsailer to indicate that the landsailer is unattended and is in fact remotely controlled.

In operation, the direction of the landsailer is dictated by the position of wheel 22, which is in turn set by remote control through the single radio control channel from radio control unit 12. Sail 34 is cleated so that it swings between two positions to either side of the centerline of the vehicle. The tricycle type wheel gear is utilized because, as illustrated in FIG. 1, when the venicle is heeled over wheels 20 and 22, contact the ground and therefore provide two points of contact during heeling. It will be appreciated that for heeling in the opposite direction, wheels 18 and 22 contact the ground.

The direction of travel of the vehicle is determined by the position of wheel 22 about axis 30, such that in response to its control signal from single channel radio control unit 12, wheel 22 is turned as illustrated at 22' in FIG. 1B to turn the vehicle into the wind. As illustrated, the pressure on wheel 54' is lessened as the vehicle turns into the wind and the angle of heel is reduced or killed. As the vehicle swings directly into the wind as illustrated in FIG. 1C, both outrigger wheels 54 and 54' come off of the ground and sail 34 luffs, along with the luffing of sheet 46.

Referring to FIG. 2, positions A, B and C are illustrated from a top view in terms of the direction of vehicle 10 vis a vis the wind direction. The turning of wheel 22 causes the vehicle to travel along path 64 with sail 34 filled as the vehicle executes the turn until such time as the vehicle is into the wind where the sail is indicated as luffing at 34' at position C.

As illustrated in FIGS. 1A and 1B, the pressure on wheel 54 is reduced as the vehicle heads up into the wind. The righting moment is, of course, proportional to the force placed on the flexible outrigger, with the more wind force, the more righting moment provided to the vehicle. This situation approximates the situation for water-borne sailing vessels, such that with an increase in wind there is a concomitant increase in righting moment as the outrigger bends. Eventually the forces produced by the outrigger and the forces produced by the wind balance, and the vehicle is maintained on a steady heeling angle, again approximating a water-borne sailing vessel.

While the piano wire flexibility provides for a linear force with respect to the wind, it will be appreciated that the outrigger structure may be configured to provide a non-linear response to the force of the wind by suitable tailoring of the diameter of the outrigger as it extends transversely from the vehicle body. Thus the heeling characteristics of the model landsailer may be tailored to any particular degree desired so as to approximate any of a variety of type of water-borne sailing vessels.

Figure 3:
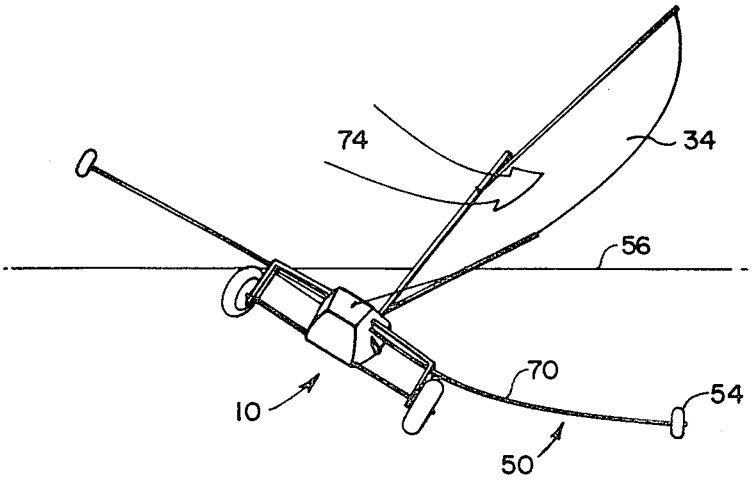
Figure 4:
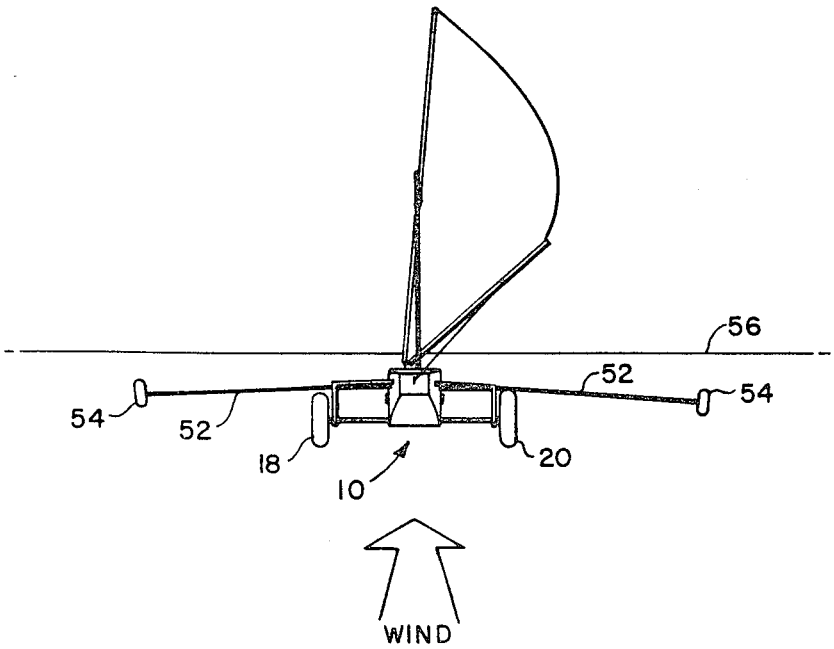

What will be appreciated from the illustrations of FIGS. 3 and 4 is that the curvature 70 of outrigger 50 results from wind force, generally indicated at 74 exerted against sail 34. The action of the flexible outrigger in resisting the wind force, provides a realistic heeling moment of the vehicle, which provides exceptionally good visual feedback to the operator of the radio control unit. So close is the approximation of the heeling moment of the landsailer to actual water-borne sailing vessels that the remotely controlled landsailer can be utilized as a teaching aid to teach sailing to novices and to provide them with an indication of how far a sailing vessel may heel before it capsizes. Control of the heel by the pointing of the vehicle into the wind is also a valuable lesson to novices. Moreover, the ability of the vessel to maintain course at a steady heeling angle can remove fear of heeling for the novice sailor, such that when he first skippers a water-borne sailing vessel, his fear of heeling will be greatly abated. Thus the model landsailer, in addition to providing an amusement device, also provides for an excellent teaching tool in the teaching of sailing.

Referring to FIG. 4, the subject landsailer is illustrated as running with the wind, with both outrigger wheels 54 off the ground. As can be seen, outrigger 52 is mounted transverse to the vehicle body and extends above the tops of wheels 18 and 20.

Figure 5:
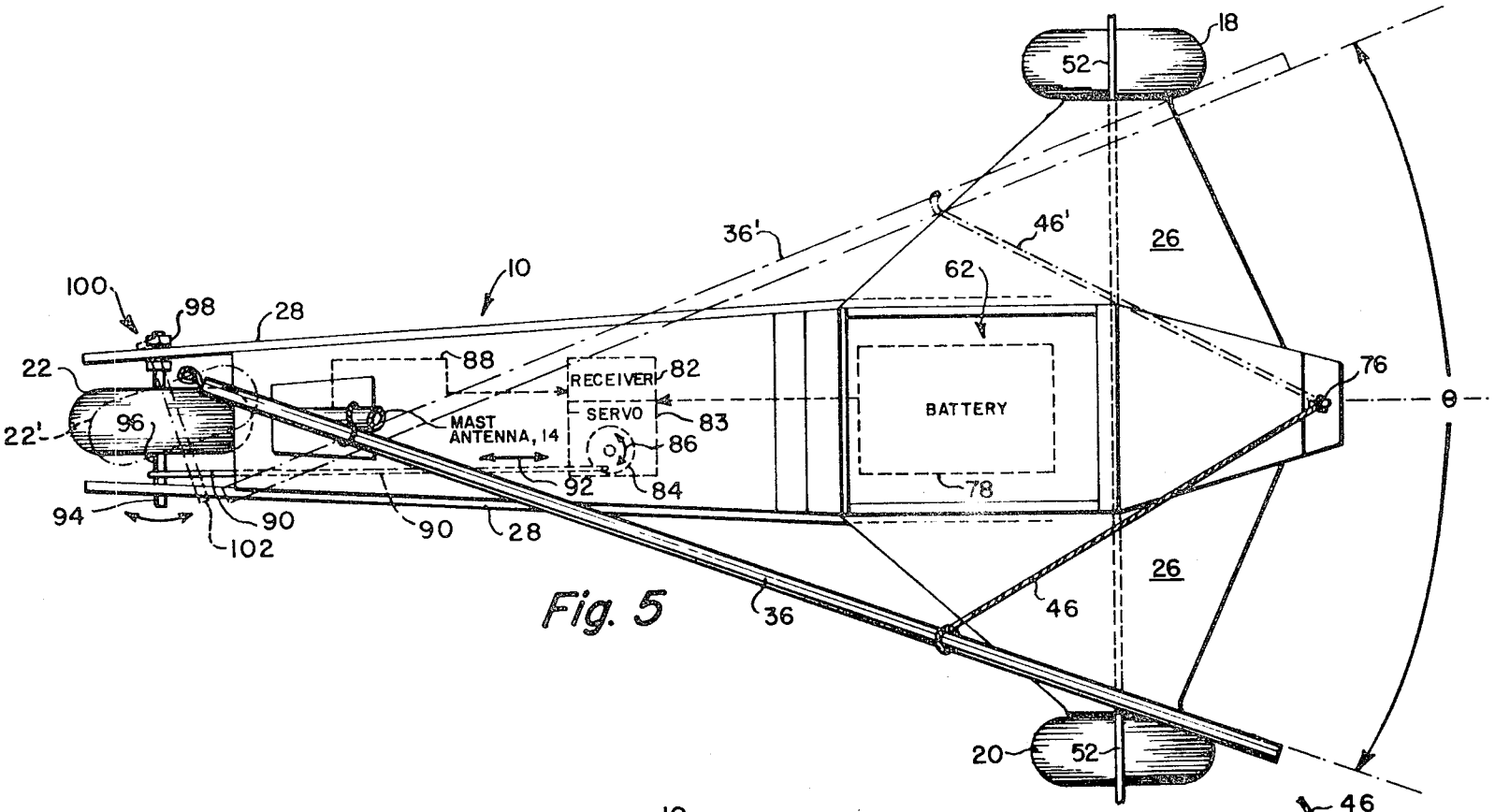

Referring to FIG. 5, a top view of model landsailer 10 illustrates the swing of boom 36 from the illustrated position to position 36' through an arc $\theta$ which is determined by the length of sheet 46, seen here anchored at a point 76 at the stern of the vehicle. The angle $\theta$, in one operative embodiment, is 60° which permits the vehicle to tack within 45° of the wind.

As shown, struts 26 support wheels 18 and 20 with outrigger 52 passing completely through the vehicle body and the struts in a position above the top portions of wheels 18 and 20. Portability is provided by the removal of the outrigger by removal of one wheel and the pulling out of the outrigger from the vehicle body.

Figure 6:
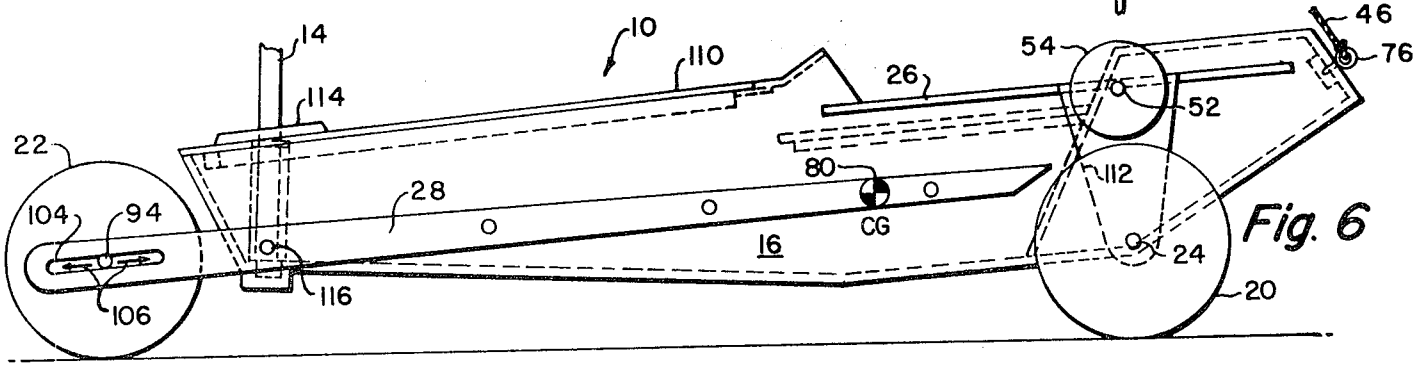
FIG. 6 is a side view of the subject landsailer, illustrating the center of gravity of the landsailer and the placement of the outrigger-carried wheel with respect to the rear wheels of the landsailer.

As can be seen, a battery 78 is located within cockpit 62 so as to provide a low center of gravity as illustrated in FIG. 6 at 80. The battery is connected to a conventional receiver 82 coupled to a servo 83 which is provided with a bell crank 84 that rotates in the direction of double ended arrow 86 in accordance with radio control signals coupled from mast/antenna 14 via line 88 to receiver 82. Linkage 90, in the form of a rod, converts the rotational movement of bell crank 84 into a translational movement as illustrated by double ended arrow 92 so as to position end 94 of axle 96 which carries wheel 22. The other end of axle 96, end 98, is coupled to yoke 26 in a single pivot structure illustrated at 100 such that wheel 22 may pivot as illustrated by dotted line 22', with the rearward movement of linkage 90 bringing the end of axle 96 to the position illustrated at 102. As illustrated in FIG. 6, end 94 of the axle is carried in a slot 104 in yoke 26 such that translation of linkage 90 causes end 94 to move in the direction of arrows 106. This single pivot control of the model landsailer contributes to the simplicity of the operation of the landsailer and also the simplicity of its construction.

Referring again to FIG. 6, body 16 of the landsailer is provided with a top cover 110 which is removable and which has a reinforced apertured member 114, through which mast 14 passes so as to be secured at a point 116 which is sufficiently forward of aperture 118 to provide a predetermined rake to mast 14. In general, mast 14 is raked at an angle of 5° to provide optimal performance for tacking and reaching. Cover 110 is removable to permit access to receiver 82 and the battery compartment.

Wheel 20 is illustrated as being rotatable about axle 24. It can be seen that outrigger 52 is vertically displaced above axle 24 with outrigger 52 providing an axle for outrigger wheel 54. In a preferred embodiment, outrigger wheel 54 is smaller than wheels 20 or 22, although this need not be the case. Both axle 24 and outrigger 52, which forms an axle, are mounted through strut 26 in that they both pass through a downward projecting flange 112. Thus, strut 26 is provided with downwardly projecting flanges at either end thereof to provide axle positioning.

Note that the length of the outrigger determines at what heeling angle the outrigger wheels touch the ground. In general, it is desirable that the outrigger wheels not touch the ground when the vehicle is not heeling because at 0°–10° from vertical, the low center of gravity provides stability without the outrigger.

Figure 7:
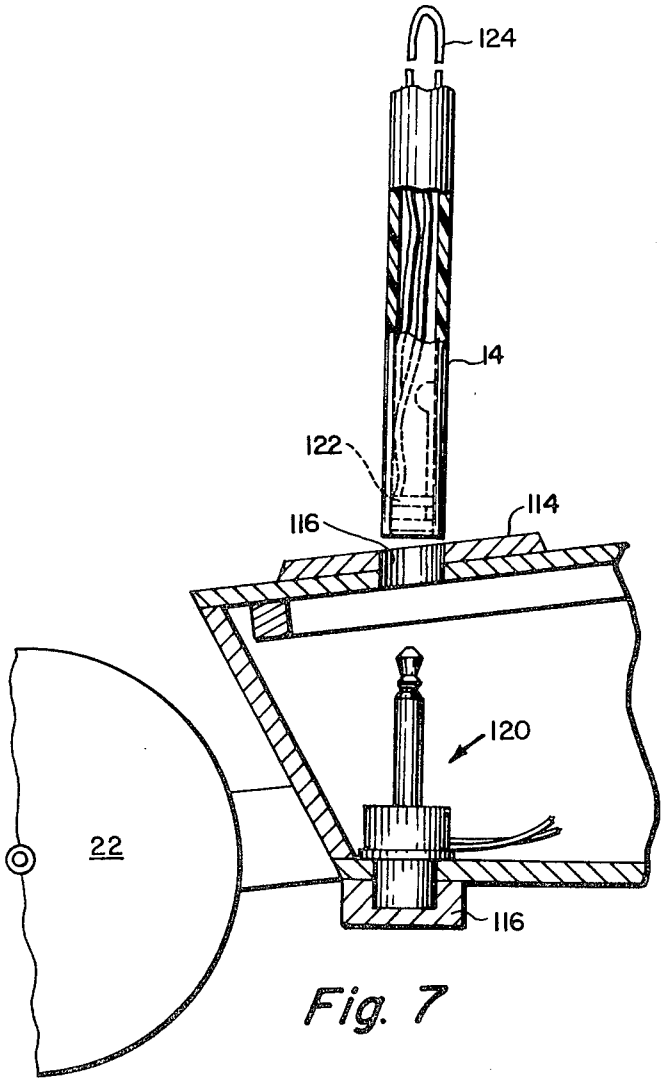
FIG. 7 is a cross-sectional and exploded view of the stepping of the mast, including an upstanding banana plug carried within the body of the landsailer and a mating banana plug connector carried within the body of the mast.

Referring now to FIG. 7, the mast stepping arrangement of FIG. 6 is illustrated in detail in which point 116 is provided with an upstanding banana plug 120, raked backwardly so as to correspond with the predetermined rake of the mast. The walls of aperture 116 are also raked as illustrated, such that when mast/antenna 14 is stepped through member 114, its centrally carried banana plug connector 122 slips over upstanding banana plug 120, thereby to connect an antenna loop 124 carried within mast 14 to receiver 82 of FIG. 5. The banana plug, mast stepping arrangement permits ready assembly and disassembly of the mast with respect to the vehicle body, thereby providing ready disassembly of the vehicle for transporting purposes.

Referring to FIG. 8, vehicle 10 is provided with a lateen sail 34 anchored to mast 14 at points 42 and 44. As mentioned previously, boom 36 is a rigid structure, as is yard 38. It can be seen that these two members are joined at 40 with the joint, as illustrated in FIG. 9, being flexible. The flexibility refers to the ability of yard 38 to rotate as illustrated by arrow 130, whereas boom 36 may rotate as illustrated by arrow 132. The rotatability of these two members provides that the sail may assume different shapes during the various maneuvers as the sail twists in response to the wind and its direction. This twistability of the rigid boom and yard contributes greatly to the sail assuming a shape which provides for maximum utilization of the wind. The boom and yard are allowed to rotate because of the flexible coupling at points 42 and 44. In one embodiment, the boom is tied at point 42 to the mast by a string or thread 134, with the yard being tied at point 44 by a string or thread 136.

As will be seen in FIG. 8, the wheel normally used at the end of the outrigger has been replaced with a skid 140 which may have a blade 142 attached thereto. Alternatively the wheel may be retained for iceboat applications. The tricycle wheels may be replaced with skids 144 and 146 so as to provide vehicle 10 with model iceboat capability when these skids are provided with blades 148 and 150 respectively.

Having above indicated a preferred embodiment of the present invention, it will occur to those skilled in the art that modifications and alternatives can be practiced within the spirit of the invention. It is accordingly intended to define the scope of the invention only as indicated in the following claims.

What is claimed is:

1. A remotely controlled unattended land sailer, comprising:

a wheeled vehicle having a body at least one sail, a mast mounted to said body for supporting said sail, a boom pivotally mounted to said mast, a sheet attached at one end to said body and at its other end to said boom for maintaining said sail at a predetermined sail set to either side of the centerline of said vehicle;

said vehicle having a single forward wheel and remotely controlled steering means for turning said wheel responsive to remote control signals;

said vehicle having means for providing realistic heeling including a flexible outrigger mounted to said vehicle along a single axis transverse to the centerline of said vehicle for flexing in a plurality of planes, said outrigger having portions extending from either side of said vehicle, said outrigger portions comprising a flexible wire, said vehicle having a pair of wheels being in fixed spaced-apart relation attached respectively to the free ends of said outrigger portions;

said wire being of a stiffness to prevent turnover of said vehicle for winds under a predetermined maximum and being of a stiffness to provide said vehicle with an amount of heel which causes said vehicle to approximate the sailing characteristics of waterborne sailboats during a tacking maneuver.

2. The vehicle of claim 1 wherein said remotely controlled steering means includes a radio receiver and wheel actuation means coupled thereto for controlling the position of said single forward wheel, and wherein said mast includes an antenna, said antenna being coupled to said receiver.

3. The vehicle of claim 2 wherein said sheet is of a length to limit the swing of said boom about said mast to a predetermined arc.

4. The vehicle claim 1 and further including a yard, the forward ends of said boom and said yard being flexibly coupled so as to permit rotation of said boom and yard about their respective longitudinal axes.

5. The vehicle of claim 1 wherein said steering means includes a single pivot mounting for said single forward wheel.

6. The vehicle of claim 8 wherein said single pivot mounting includes a yoke connected to said vehicle, an axle for said one wheel having one end thereof pivoted about a generally vertically extending axis at one side of said yoke, the other side of said yoke having a horizontal slot for accommodating therein the other end of said axle, said steering means including means for selectively positioning said other end of said axle within said slot.

7. A wind driven vehicle having means for providing realistic heeling, said means comprising a flexible outrigger mounted to said vehicle along a single axis transverse to said vehicle centerline and being flexible throughout its length and in a plurality of planes, said outrigger comprising a wire with a stiffness sufficient to prevent overturn of said vehicle for predetermined wind conditions, said wire being sufficiently stiff to provide heeling which approximates a waterborne vehicle during a tacking maneuver, said vehicle having ground-contacting means at either end of said outrigger.

8. The vehicle of claim 1 wherein said ground contacting means are wheels.

9. The vehicle of claim 1 wherein said ground contacting means are runners.

10. An unattended wind driven vehicle comprising:

a wheeled vehicle having at least one sail and means for mounting said sail to said vehicle; and, remotely controlled steering means coupled to at least one of the wheels of said vehicle for controlling direction of travel of said vehicle;

said steering means including a single pivot mounting for said one wheel;

said single pivot mounting including a yoke connected to said vehicle and an axle for said one wheel having one end thereof pivoted about a generally vertical extending axis at one side of said yoke, the other side of said yoke having a horizontal slot for accommodating therein the other end of said axle said steering means including means for selectively positioning said other end of said axle within said slot.

* * * * *

UNITED STATES PATENT AND TRADEMARK OFFICE

CERTIFICATE OF CORRECTION

PATENT NO. : 4,426,806

DATED : January 24, 1984

INVENTOR(S) : Lee M. Woodworth

It is certified that error appears in the above—identified patent and that said Letters Patent is hereby corrected as shown below:

| | | |
|---|---|---|
| Column 3 | Line 50, | "channel or control." should read --channel of control.-- |
| Column 8 | Line 67, | "having a body at" should read --having a body, at-- |
| Column 10 | Line 1, | "6. The vehicle of claim 8" should read --6. The vehicle of claim 5-- |
| | Line 23, | "The vehicle of claim 1" should read --The vehicle of claim 7-- |
| | Line 39, | "said axle said" should read --said axle, said-- |

Signed and Sealed this

*Seventeenth* Day of *December 1985*

[SEAL]

*Attest:*

DONALD J. QUIGG

*Attesting Officer*

*Commissioner of Patents and Trademarks*